United States Patent [19]

Tachikawa et al.

[11] Patent Number: 4,681,832

[45] Date of Patent: Jul. 21, 1987

[54] ELECTROPHOTOGRAPHIC LIQUID DEVELOPER

[75] Inventors: Hiromichi Tachikawa; Hiroaki Yokoya; Syu Watarai; Katuzi Kitatani, all of Kanagawa, Japan

[73] Assignee: Fuji Photo Film Co., Ltd., Kanagawa, Japan

[21] Appl. No.: 817,650

[22] Filed: Jan. 10, 1986

[30] Foreign Application Priority Data

Jan. 10, 1985 [JP] Japan ..... 60-2518

[51] Int. Cl.[4] ..... G03G 9/12

[52] U.S. Cl. ..... 430/115

[58] Field of Search ..... 430/114, 115

[56] References Cited

U.S. PATENT DOCUMENTS

| | | | |
|---|---|---|---|
| 3,933,667 | 1/1976 | Machida et al. | 430/114 |
| 4,147,812 | 4/1979 | DeVolder et al. | 430/114 X |
| 4,157,973 | 6/1979 | Moutillier | 430/114 |
| 4,170,563 | 10/1979 | Merrill et al. | 430/115 |
| 4,614,699 | 9/1986 | Kitatani et al. | 430/115 |

FOREIGN PATENT DOCUMENTS

| | | | |
|---|---|---|---|
| 2221028 | 11/1972 | Fed. Rep. of Germany | 430/114 |
| 2303670 | 8/1973 | Fed. Rep. of Germany | 430/114 |
| 49-20996 | 5/1974 | Japan | 430/115 |

*Primary Examiner*—Roland E. Martin

*Attorney, Agent, or Firm*—Sughrue, Mion, Zinn, Macpeak & Seas

[57] ABSTRACT

A novel electrophotographic liquid developer is provided, comprising a coloring agent, a coating agent, a dispersant, an electric charge adjustor, and a carrier liquid, wherein said coating agent is a copolymer of a long-chain alkyl acrylate or methacrylate and a methyl methacrylate, and has a softening temperature within the range of from 40° to 140° C. and a number-average molecular weight of from $5\times10^3$ to $1\times10^5$. The long-chain alkyl group is a straight-chain or branched alkyl group having from 8 to 22 carbon atoms. In preferred embodiments, the long-chain alkyl methacrylate is 2-ethylhexyl methacrylate, lauryl methacrylate, or stearyl methacrylate.

19 Claims, No Drawings

ELECTROPHOTOGRAPHIC LIQUID DEVELOPER

FIELD OF THE INVENTION

The present invention relates to an electrophotographic liquid developer having an excellent image-forming property and fixing property.

BACKGROUND OF THE INVENTION

In general, electrophotographic processes, methods for developing formed electrostatic latent images include a dry development process such as a cascade process and a magnetic brush process and a liquid development process using a dispersion of toner particles in a nonaqueous solvent having a high electrical insulation property and a low dielectric constant. The latter method is most suitable for faithful reproduction of fine images or intermediate tone because it can use finer toner particles than the former.

In general, a liquid developer's properties with respect to fixing images is governed by a coating agent and a dispersant. Of the two factors, the properties of the coating agent are the most important. Examples of coating agent include alkyd resins, linseed oil-modified alkyd resins, rosinic resins, hydrogenated rosinic resins, terpene resins, rubbers such as styrene-butadiene rubber and cyclized rubber, styrene resins, vinyl toluene resins, polyester resins, and vinyl polyacetate resins. However, most of these resins are disadvantageous in that their fixing properties are poor.

Furthermore the coating agent must have another important property. Particularly, when attached to or bonded to a coloring agent to allow the formation of toner particles, the coating agent must be capable of easily making a dispersion of finely divided particles and also capable of making the thus-dispersed particles stably present in a carrier liquid.

In conventional coating agents, a coating agent which fully satisfies the desired image fixing, particle dispersing, and particle stabilizing properties at the same time has not been known.

As previously described, the liquid development process is excellent in reproduction of fine images and intermediate tone as compared to the dry development process. However, the liquid development is disadvantageous in that when a liquid developer is allowed to flow at a high speed, the image formed exhibits a tail-like run at its downstream side. This problem can be somewhat reduced by reducing the flow rate of the developer. However, this is not necessarily a preferable solution, because the reduction of the flow rate causes an increase in the process time and a decrease in development density. It is therefore desired that this problem be solved by improving the properties of the toner particles.

SUMMARY OF THE INVENTION

Therefore, one object of the present invention is to provide an electrophotographic liquid developer having an excellent image-fixing property while simultaneously fully satisfying desired particle dispersing and particle stabilizing properties.

Another object of the present invention is to provide an electrophotographic liquid developer capable of forming excellent images without casing image run.

These and other objects of the present invention will become more apparent from the following detailed description and examples.

As a result of extensive studies, the inventors have accomplished these objects of the present invention by an electrophotographic liquid developer comprising a coloring agent, a coating agent which fixes coloring agent at image parts, a dispersant, an electric charge adjustor, and a carrier liquid, wherein said coating agent is a copolymer of a long-chain alkyl acrylate or methacrylate, wherein the long-chain alkyl group is a straight-chain or branched alkyl group having from 8 to 22 carbon atoms and methyl methacrylate, and has a softening temperature within the range of from 40° to 140° C. and a number-average molecular weight of from $5\times10^3$ to $1\times10^5$.

A developer prepared in accordance with the present invention can not only easily disperse fine particles but also shows an excellent fixing property. The developer of the present invention can provide good images without tail-like runs.

DETAILED DESCRIPTION OF THE INVENTION

The present invention will be hereinafter described in further detail.

As the carrier liquid of the present invention, a nonaqueous solvent may be used having an electrical resistance of $1\times10^9$ Ω·cm or more and a dielectric constant of 3 or less. Examples of such a nonaqueous solvent include straight-chain or branched aliphatic hydrocarbon solvents, alicyclic hydrocarbon solvents, aromatic hydrocarbon solvents, and halogenated hydrocarbon solvents. However, consisting matters of volatility, safety, pollution, and odor, octane, isooctane, decane, dodecane, isododecane, nonane, idoparaffinic petroleum solvents such as Isopar-E, Isopar-G, Isopar-H, and Isopar-L ("Isopar" is a trademark of such a series of products made by Exxon Corp.), Solvesso-100, and Shellsol-71 (product made by Shell Corp.) may be preferably used.

When attached to or bonded to a coloring agent to form toner particles, the coating agent, as an essential component in the present invention must be fully miscible with the coloring agent. Furthermore, the resulting mixture must be easily dispersed as finely divided particles. These finely divided particles of the mixture must be stably present in the above mentioned carrier liquid. In order to meet these requirements, the coating agent must have both an affinity for a carrier liquid to dissolve or swell the carrier liquid and insolubility in the carrier liquid at the same time. If an isoparaffinic solvent which is suitable as a carrier liquid for the liquid developer of the present invention is used, a monomer having long-chain alkyl groups is most suitable as the component having an affinity for the carrier liquid. As the long-chain alkyl groups, preferably used are straight-chain or branched alkyl groups having from 8 to 22 carbons atoms, and more preferably alkyl groups having from 12 to 18 carbons atoms. A copolymer containing a stearyl methacrylate having 18 carbon atoms is an especially preferred embodiment of the present invention. The component having an insolubility in the carrier liquid mainly comprises a component which contributes to the adhesion of the coating agent to the coloring agent and the fixation of formed images. From the viewpoint of image intensity methyl methacrylate was most useful as other component of the copolymer coating agent of the present invention.

In order to meet all the above requirements, the coating agent of the present invention requires that the copolymerization molar ratio of the long-chain alkyl(meth)acrylate to the methylmethacrylate be within a specified range, preferably from 0.1/9.9 to 5/5. This range depends on the carrier liquid used. For example, if an isoparaffinic petroleum solvent is used, the molar ratios of 2-ethylhexylmethacrylate to methyl methacrylate, lauryl methacrylate to methyl methacrylate, and stearyl methacrylate to methyl methacrylate are preferably within the ranges of from 5/5 to 0.5/9.5, from 3/7 to 0.5/9.5, and from 2/8 to 0.1/9.9, respectively. If the content of the long-chain alkyl group exceeds the above molar proportion, the adhesion of the coating agent to the coloring agent upon dispersion is lowered and the image intensity is also lowered. On the contrary, if the content of the long-chain alkyl group is less than the above range, intimate mixing of the coating agent with the coloring agent and dispersion of finely divided particles are prevented.

For similar reasons, the coating agent of the present invention has a preferable range of molecular weight and softening temperature. The number-average molecular weight is within the range of from $5\times10^3$ to $1\times10^5$ in terms of the molecular weight of standard polystyrene determined by the GPC process. If the molecular weight of the coating agent is less than the above range, intimate mixing with the coloring agent can be provided, but the image intensity is lowered. For similar reasons and in the light of ease of fixation of formed images and image intensity, the softening temperature of the coating agent is within the range of from 40° to 140° C., and more preferably within the range of from 50° to 120° C.

The preparation of the coating agent can be accomplished by copolymerizing the above mentioned group of monomers in a desired proportion. The polymerization can be accomplished by known methods such as solution polymerization, suspension polymerization, precipitation polymerization, and emulsion polymerization. For example, if solution polymerization is used, a solution of copolymer can be obtained by mixing such monomers in a solvent such as benzene and toluene in a predetermined proportion and allowing the mixture to be polymerized by a radical polymerization initiator such as azobisisobutyronitrile, benzoyl peroxide and lauryl peroxide. A desired copolymer can be obtained by drying or adding the solution to a poor solvent. If suspension polymerization is used, a desired copolymer can be obtained by polymerizing such monomers in the presence of a radical polymerization initiator while they are kept in suspension in the presence of a dispersant such as polyvinyl alcohol and polyvinyl pyrrolidone. In these polymerizations, a chain transfer agent such as mercaptan represented by lauryl mercaptan can be used to adjust the molecular weight.

As the coloring agent of the present invention, known pigments or dyes which have heretofore been used for liquid developer may be employed, singly or in combination. Examples of these pigments or dyes include Hansa Yellow (C.I. 11680), Benzidine Yellow G (C.I. 21090), Benzidine Orange (C.I. 21110), Fast Red (C.I. 37085), Brilliant Carmine 3B (C.I. 16016-Lake), Phthalocyanine Blue (C.I. 74160), Phthalocyanine Blue (C.I. 74260), Victorian Blue (C.I. 42595-Lake), Spirit Black (C.I. 50415), Oil Blue (C.I. 74350), Alkali Blue (C.I. 42770A), Fast Scarlet (C.I. 12315), Rhodamine 6B (C.I. 45160), Fast Sky Blue (C.I. 74200-Lake), Nigrosine (C.I. 50415) and carbon black. Surface-treated pigment such as carbon black dyed with Nigrosine or graft carbon prepared by graft polymerization of polymers to carbon black can also be used.

In order to improve the disspersability and stability of the liquid developer of the present invention, known dispersants may be used. The dispersant of the present invention is a resin which improves the dispersability of the toner. As such a resin there may be employed a resin which improves the dispersability of the toner by being dissolved into or swelled with the carrier liquid. Examples of such a dispersant include rubbers such as styrene-butadiene, vinyl toluene-butadiene, and butadiene-isoprene polymers of acrylic monomers having long-chain alkyl groups such as 2-ethylhexyl(meth)acrylate, lauryl(meth)acrylate, and stearyl(meth)acrylate, and copolymers of acrylic monomers with other monomers (styrene, (meth)acrylic acid, and methyl, ethyl and propyl esters thereof), graft copolymers and block copolymers prepared from the above described polymers and monomers. Of these preferable dispersants, dispersants of synthetic rubbers are more useful. In particular, random or block copolymers of styrene-butadiene copolymers can be used as extremely useful dispersants.

As the electric charge adjustor of the present invention there may be employed known electric charge adjustors. Examples of such electric charge adjustors include metallic salts of aliphatic acids such as naphthenic acid, octanoic acid, oleic acid, and stearic acid, metallic salts of sulfosuccinate, oil-soluble metallic salts of sulfonic acids as disclosed in Japanese Patent Publication No. 556/70 and Japanese Patent Application (OPI) Nos. 37435/77 and 37049/77, metallic salts of phosphoric esters as disclosed in Japanese Patent Publication No. 9594/70, metallic salts of abietic acid or hydrogenated abietic acid as disclosed in Japanese Patent Publication No. 25666/73, calcium salts of alkylbenzenesulfonic acid as disclosed in Japanese Patent Publication No. 2620/80, metallic salts of an aromatic carboxylic acid or sulfonic acid as disclosed in Japanese Patent Application (OPI) Nos. 107837/77, 38937/77, 90643/82, and 139753/72, nonionic surface active agents such as polyoxyethylated alkylamine, fatty oils such as lecithin and linseed oil, polyvinyl pyrrolidone, organic acid esters of polyvalent alcohols, phosphoric ester surface active agents as disclosed in Japanese Patent Application (OPI) No. 210345/82, and sulfonic acid resins as disclosed in Japanese Patent Publication No. 24944/81. Amino acid derivatives as disclosed in Japanese Patent Application (OPI) No. 21056/85 and Japanese Patent Application No. 172955/84 may also be used. The amino acid derivative is a reaction mixture obtained by mixing with water a reaction mixture which has been obtained by reacting a compound of formula (1) or (2) shown below or an amino acid with a titanium compound in an organic solvent.

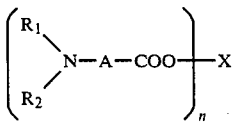

(1)

-continued (2)

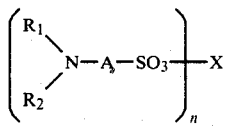

wherein $R_1$ and $R_2$ each represents a hydrogen atom, an alkyl group having from 1 to 22 carbon atoms, a substituted alkyl group (a dialkylamino group, alkyloxy group, or alkylthio group may be used a substituent), an aryl group having from 6 to 24 carbon atoms, a substituted aryl group having from 6 to 24 carbon atoms (examples of substituents include dialkylamino group, alkyloxy group, alkylthio group, chloro group, bromo group, cyano group, nitro group, or hydroxyl group may be used as a substituent), aralkyl group, an acyl group having from 1 to 22 carbon atoms, alkylsulfonyl group, alkylphosphonyl group or an arylsulfonyl or arylphosphonyl group having from 6 to 24 carbon atoms, $R_1$ and $R_2$ being the same or different from each other, $R_1$ together with $R_2$ optionally forming a ring, provided that $R_1$ and $R_2$ do not both represent hydrogen atoms at the same time; A represents an alkylene group having from 1 to 10 carbon atoms or a substituted alkylene group having from 1 to 10 carbon atoms; X represents a hydrogen atom, monovalent, divalent, trivalent, or tetravalent metal or quaternary ammonium cation; and n represents a positive integer.

Preferable among these electronic charge adjustors are metallic salts of naphthenic acid, metallic salts of dioctylsulfosuccinic acid, lecithine and the above-mentioned amino acid derivatives. More preferable examples of these electric charge adjustors include zirconium naphthenate, cobalt naphthenate, manganese naphthenate, calcium dioctylsulfosuccinate, sodium dioctylsulfosuccinate, and metallic salts of the compound of formula (1). More preferable examples of such metallic salts of the compound of formula (1) include titanium salts, cobalt salts, zirconium salts, and nickel salts of the compound of formula (1).

These electric charge adjustors may be used in combination.

The liquid developer of the present invention can be prepared by known methods.

In particular, a coloring agent comprising a pigment and/or a dye and the above-mentioned coating agent are first heated to the softening temperature of the coating agent or higher, and then kneaded by means of a suitable kneader such as a Banbury Mixer, Co-Kneader, and three rolls mill. The materials thus kneaded are allowed to cool to obtain an intimate mixture. Various solvents may optionally be added to the materials while they are being kneaded. The preparation of such an intimate mixture may also be accomplished by kneading the above-mentioned coloring agent and coating agent in a solvent by means of a kneader such as ball mill and Paint Shaker, and then drying or adding the materials thus kneaded to a non-solvent.

The intimate mixture thus obtained is optionally dry-ground by means of a Roto Plex, Pin Mill, or the like, and then wet-ground with a dispersant to prepare a concentrated developer. As the solvent which is added to the materials while they are being wet-ground carrier liquids or solvents such as toluene and acetone may be used.

The concentrated toner solution thus obtained is dispersed into a nonaqueous solvent containing an electric charge adjustor to prepare a desired electrophotographic liquid developer. The concentration of toner particles in the developer is not specifically restricted, but is usually from 0.01 to 100 g, and preferably from 0.1 to 10 g, per 1 l (liter) of carrier liquid. The coating agent may be contained in the particulate toner in an amount of from 0.1 to 20 parts by weight, and preferably from 0.5 to 5 parts by weight based on 1 part of the coloring agent.

The concentration of the dispersant is usually from 0.01 to 50 g, and preferably from 0.1 to 10 g, per liter of carrier liquid. The electric charge adjustor may be added by methods other than the above method. That is, the electric charge adjustor may be added to the materials while they are being kneaded and/or while they are being wet-ground. The added amount of the electric charge adjustor is preferably from 0.001 to 10 g, and more preferably from 0.01 to 1 g, per 1 l of the developer.

The developer of the present invention can be used for photosensitive materials employing a known organic photoconductive material or inorganic photoconductive material. The developer of the present invention may be used for development of electrostatic latent images produced by charging of a dielectric material by a process other than exposure to light, such as charged needle.

As such an organic photoconductive material there may be used a wide variety of known organic photoconductive materials. Examples of such an organic photoconductive material include an organic photoconductive material described in an article titled "Electrophotographic Elements, Materials and Processes", at page 61 on the May 1973 issue of *Research Disclosure* RD No. 10938.

Examples of organic photographic materials which have been put into practical use include an electrophotographic material made of poly-N-vinylcarbazol and 2,4,7-trinitrofluorene-9-on as disclosed in U.S. Pat. No. 3,484,239, an electrophotographic material comprising poly-N-vinylcarbazol sensitized by a pyrylium salt dye as disclosed in Japanese Patent Publication No. 25658/73, an electrophotographic material mainly comprising an organic pigment as disclosed in Japanese Patent Application (OPI) No. 37543/74 and an electrophotographic material mainly comprising a eutectic complex made of a dye and a resin as disclosed in Japanese Patent Application (OPI) No. 10735/72.

Typical examples of inorganic photoconductive materials which may be used in the present invention include various inorganic compounds as disclosed, e.g., in *Electrophotography* (written by R. M. Schaffert, published by Focal Press (London, 1975), pp. 260–374. Examples of such inorganic compounds include zinc oxide, zinc sulfide, cadmium sulfide, selenium, selenium-tellurium alloy, selenium-arsenic alloy, and selenium-tellurium-arsenic alloy.

The process for the formation of images with an electrophotographic liquid developer of the present invention may be accomplished by known methods. In particular, the surface of an electrophotographic material is positively or negatively charged by means of a corona charging apparatus or the like. The surface of the photographic material thus charged is image-wise exposed to light to form electrostatic images thereon which is then brought into contact with a liquid developer of the invention to form desired images. These images may optionally be transferred to another support. After being dried, these images are fixed. The fixing process may be accomplished by a heat-fixing process comprising bringing the material into contact with hot air or heat roller or irradiating the material with infrared rays, light, flash light, or high frequency wave, a solvent fixing process comprising bringing the material into contact with a developer or vapor of a solvent having an affinity for the photographic material, or a pressure fixing process using a pressure roller.

EXAMPLES

An example of preparation of a coating agent of the present invention and examples of preparation of liquid developers of the present invention are described below. However, the present invention is not limited to these examples

EXAMPLE OF PREPARATION OF COATING AGENT 300 g of toluene and 200 g of 2-ethylhexyl methacrylate-methyl methacrylate (molar proportion: 1/9) monomers were put into a reaction vessel provided with a reflux condenser and agitating blades and heated to a temperature of 80° C. in a nitrogen gas flow. 2 mol%, based on the monomer, of azobisisobutyronitrile was added to the material in the reaction vessel and then subjected to polymerization for 5 hours to obtain a polymer solution which was then cooled. The polymer solution thus prepared was precipitated in a large amount of methanol and dried to obtain a 2-ethylhexyl methacrylate-methyl methacrylate (molar proportion: 1/9) copolymer which showed a number-average molecular weight of $1.3\times10^4$ and a softening temperature of from 80° to 120° C. The copolymer thus obtained was referred to as Coating Agent No. 1. Coating Agents No. 2 to No. 9 in Table 1 were obtained in similar manners. Likewise, coating agents No. 10 and No. 11 were obtained by using 0.5 mol%, based on the monomer, of azobisisobutyronitrile.

TABLE 1

| Coating Agent No. | Long-chain Alkyl Methacrylate | Molar Proportion of Long-chain Alkyl Methacrylate to Methyl Methacrylate | Number-average Molecular Weight | Softening Temp. (°C.) |
|---|---|---|---|---|
| 1 | 2EHMA | 1/9 | $1.3\times10^4$ | 80 to 120 |
| 2 | 2EHMA | 2/8 | $1.4\times10^4$ | 40 to 80 |
| 3 | LMA | 1/9 | $1.3\times10^4$ | 70 to 100 |
| 4 | LMA | 2/8 | $1.3\times10^4$ | 50 to 80 |
| 5 | SMA | 0.25/9.75 | $1.2\times10^4$ | 90 to 120 |
| 6 | SMA | 0.5/9.5 | $1.2\times10^4$ | 80 to 100 |
| 7 | SMA | 1/9 | $1.4\times10^4$ | 60 to 80 |
| 8 | SMA | 1.5/8.5 | $1.4\times10^4$ | 50 to 80 |
| 9 | SMA | 2/8 | $1.6\times10^4$ | 50 to 70 |
| 10 | SMA | 0.5/9.5 | $3.2\times10^4$ | 80 to 100 |
| 11 | SMA | 1/9 | $3.4\times10^4$ | 70 to 85 |

*The abbreviations in the table have the following meanings:
2EHMA: 2-ethylhexyl methacrylate
LMA: Lauryl methacrylate
SMA: Stearyl methacrylate

EXAMPLE 1

Coating Agent No. 1 and a Carbon Black 40 (carbon black produced by Mitsubishi Kasei K.K.) were fully mixed with each other in a weight proportion of 1.5/1.0. The mixture was melt-kneaded by means of a triple roll mill which had been heated to a temperature of 140° C. A mixture of 12 g of the above materials thus kneaded, 4 g of a styrene-butadiene copolymer (Solprene-1205, available from Asahi Kasei K.K.) and 76 g of Isopar-G (available from Exxon Corp.) was dispersed by means of a Dyno-Mill. The resulting concentrated toner solution was diluted with Isopar-G in such a manner that the solid content reached 1 g/l. Furthermore, sodium dioctylsulfosuccinate was added to the solution in an amount of $1\times10^{-4}$ mol/l to prepare a developer. The developer thus prepared was used to develop images in Panacopy KV-3000 (available from Matsushita Denki K.K.), which is an electrophotographic system. The resulting images had an extremely high resolving power and excellent reproduction of tone. The images thus developed showed a strong fixation upon a peel test using an adhesive tape.

COMPARATIVE EXAMPLE 1

For comparison, another liquid developer was prepared with a n-butyl methacrylate-methyl methacrylate (1/9) copolymer (number-average molecular weight: $1.5\times10^4$) in the same manner as used in Example 1. The developer thus prepared was used in the same test as in Example 1. The images thus developed had tail-like runs in the direction of the flow of the liquid developer, and thus were poor as compared to those developed in Example 1 according to the invention.

EXAMPLE 2

A liquid developer was prepared in the same manner as used in Example 1, except that Coating Agent No. 1 was replaced by Coating Agent No. 2 (2-ethylhexyl methacrylate-methyl methacrylate (2/8) copolymer). The liquid developer thus prepared had an excellent image-forming property and high fixing power.

EXAMPLE 3

A liquid developer was prepared in the same manner as used in Example 1, except that Coating Agent No. 1 was replaced by Coating Agent No. 3 (Lauryl methacrylate-methyl methacrylate (1/9) copolymer). The liquid developer thus prepared had an excellent image-forming property and high fixing power.

EXAMPLE 4

A concentrated toner solution was prepared in accordance with the same process as used in Example 1, except that Coating Agent No. 1 was replaced by Coating Agent No. 4 (Lauryl methacrylate-methyl methacrylate (2/8) copolymer). The concentrated toner solution thus prepared was diluted with Isopar-H in such a manner that the solid content reached 1 g/l. Furthermore, a nickel salt of the compound of the formula shown below was added to the solution in an amount of $10^{-4}$ mol/l to prepare a liquid developer.

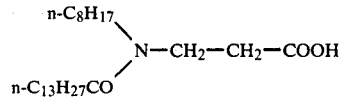

Ektavolt SO-102, an electrophotographic film commercially available from Eastman Kodak Company, was charged to +400 V and imagewise exposed to light to form electrostatic latent images thereon. The electrophotographic film thus processed was treated with the above developer to develop electrostatic images. The images thus developed were heated to a temperature of 100° C. for 2 minutes so that they were fixed. The resulting images had an excellent gradation and fixation.

EXAMPLE 5

A liquid developer was prepared in the same manner as used in Example 4, except that Coating Agent No. 4 was replaced by Coating Agent No. 7 (stearyl methacrylate-methyl methacrylate (1/9) copolymer). The resulting images had an excellent gradation and fixation.

EXAMPLE 6

A liquid developer was prepared in the same manner as used in Example 4, except that Coating Agent No. 4 was replaced by Coating Agent No. 8 (stearyl methacrylate-methyl methacrylate (1.5/8.5) copolymer). The resulting images had excellent gradation and fixation.

EXAMPLE 7

Coating Agent No. 6 in Table 1 (stearyl methacrylate-methyl methacrylate (0.5/9.5) copolymer) and Carbon Black #30 (Mitsubishi Kasei K.K.) were mixed with each other in a weight proportion of ½ and then kneaded at a temperature of 120° C. by means of an extruder. After being dried, the material thus kneaded was ground. A mixture of 10 g of the powder thus prepared, 10 g of lauryl methacrylate polymer (number-average molecular weight: $1\times10^5$) and 80 g of Isopar-H was dispersed by means of a Dyno Mill. The resulting concentrated toner solution was diluted with Isopar-H in such a manner that the solid content reached 1 g/l. Furthermore, the titanium salt of amino acid derivative as shown in Example 4 was added to the solution in an amount of $0.75\times10^{-4}$ mol/l to prepare a developer. The electrophotographic film which is used in A. B. Dick/Scott System 200 (Trademark, produced by James River Corp.) was charged and imagewise exposed to light to form electrostatic latent images thereon. The images were developed by the above developer. As a result, excellent quality images were obtained.

EXAMPLE 8

A liquid developer was prepared in the same manner as used in Example 7 except that the Coating Agent No. 6 was replaced by the Coating Agent No. 5 (stearyl methacrylate-methyl methacrylate (0.25/9.75) copolymer). As a result, excellent quality images were obtained.

EXAMPLE 9

Coating Agent No. 10 in Table 1 (stearyl methacrylate-methyl methacrylate (0.5/9.5) copolymer) and Carbon Black #40 were fully mixed with each other in a weight proportion of ½ and kneaded by means of a triple roll mill which had been heated to a temperature of 120° C. After being dried, the material thus kneaded was ground. A mixture of 10 g of the material thus ground, 5 g of a styrene-butadiene copolymer (Solprene-1204, made by Ashai Kasei K.K.) and 85 g of Isopar-G was dispersed by means of a Dyno Mill to prepare a concentrated toner solution. The concentrated toner solution thus prepared was diluted with Isopar-G in such a manner that the solid content reached 1 g/l. Furthermore, the titanium salt of amino acid derivative as shown in Example 4 was added to the solution in an amount of $1\times10^{-4}$ mol/l to obtain a liquid developer. An electrophotographic film available from James River Corp. as described in Example 7 was charged and imagewise exposed to light. The resulting electrostatic latent images were developed by the above developer and then flash-fixed by means of Torapen-up TU-275 (Riso Kagaku K.K., flashing machine producing a film for over-head projection). The resulting images had excellent quality and fixation.

EXAMPLE 10

A liquid developer was prepared in the same manner as in Example 8, except that Coating Agent No. 10 was replaced by Coating Agent No. 11 (stearyl methacrylate-methyl methacrylate (1/9) copolymer). The liquid developer thus prepared had an excellent image-forming property and fixing power.

EXAMPLE 11

A liquid developer was prepared in the same manner as in Example 8, except that Coating Agent No. 10 was replaced by Coating Agent No. 9 (stearyl methacrylate-methyl methacrylate (2/8 ) copolymer). The liquid developer thus prepared had an excellent image-forming property and high fixing power.

While the invention has been described in detail and with reference to specific embodiments thereof, it will be apparent to one skilled in the art that various changes and modifications can be made therein without departing from the spirit and scope thereof.

What is claimed is:

1. An electrophotographic liquid developer comprising a coloring agent, a coating agent, a dispersant, an electric charge adjustor, and a carrier liquid, wherein said coating agent is a copolymer of a long-chain alkyl acrylate or methacrylate and methylmethacrylate, wherein the long-chain alkyl group is a straight-chain or branched alkyl group having from 8 to 22 carbon atoms, the copolymer has a softening temperature within the range of from 40 to 140° C. and a number-average molecular weight of from $5\times10^3$ to $1\times10^5$ and the copolymer of the long-chain alkyl acrylate or methacrylate to methylmethacrylate has a copolymerization molar ratio of from 0.1/9.9 to 5/5 and the electric charge adjustor is an amino acid derivative reaction mixture obtained by mixing with water a reaction mixture which has been obtained by reacting a compound of formula (1) or (2) shown below or an amino acid with a titanium compound in an organic solvent:

(1)

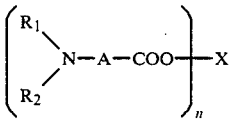

(2)

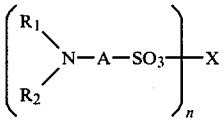

wherein $R_1$ and $R_2$ each represents a hydrogen atom, an alkyl group, a substituted alkyl group, an aryl group, a substituted aryl group, an aralkyl group, an acyl group, an alkylsulfonyl group, an alkylphosphonyl group or an arylsulfonyl or an arylphosphonyl, wherein $R_1$ and $R_2$ can be the same or different from each other and wherein $R_1$ together with $R_2$ can optionally form a ring, provided that $R_1$ and $R_2$ do not both represent hydrogen atoms at the same time; A represents an alkylene group or a substituted alkylene group, X represents a hydrogen atom, a monovalent, divalent, trivalent, or tetravalent metal or a quaternary ammonium cation; and n represents a positive integer.

2. An electrophotographic liquid developer as in claim 1, wherein the long-chain alkyl group is a straight-chain or branched alkyl group having from 12 to 18 carbon stoms.

3. An electrophotographic liquid developer as in claim 1, wherein the softening temperature of the copolymer is within the range of from 50° to 120° C.

4. An electrophotographic liquid developer as in claim 1, wherein the long-chain alkyl methacrylate is 2-ethylhexyl methacrylate.

5. An electrophotographic liquid developer as in claim 1, wherein the long-chain alkyl methacrylate is lauryl methacrylate.

6. An electrophotographic liquid developer as in claim 1, wherein the long-chain alkyl methacrylate is stearyl methacrylate.

7. An electrophotographic liquid developer as in claim 1, wherein the carrier liquid is an isoparaffinic solvent.

8. An electrophotographic liquid developer as in claim 1, wherein the electric charge adjustor is an amino acid derivative.

9. An electrophotographic liquid developer as in claim 2, wherein the softening temperature of the copolymer is within the range of from 50° to 120° C.

10. An electrophotographic liquid developer as in claim 4, wherein the molar ratio of 2-ethylhexylmethacrylate to methyl methacrylate is within the range of from 5/5 to 0.5/9.5.

11. An electrophotographic liquid developer as in claim 5, wherein the molar ratio of lauryl methacrylate to methyl methacrylate is within the range of from 3/7 to 0.5/9.5.

12. An electrophotographic liquid developer as in claim 6, wherein the molar ratio of stearyl methacrylate to methyl methacrylate is within the range of from 2/8 to 0.1/9.9.

13. An electrophotographic liquid developer as in claim 10, wherein the softening temperature is within the range of from 50° to 120° C.

14. An electrophotographic liquid developer as in claim 11, wherein the softening temperature is within the range of from 50° to 120° C.

15. An electrophotographic liquid developer as in claim 12, wherein the softening temperature is within the range of from 50° to 120° C.

16. An electrophotographic liquid developer as in claim 1, wherein $R_1$ and $R_2$ represent an alkyl group having from 1 to 22 carbon atoms, an aryl group having from 6 to 24 carbon atoms, an acyl group, an alkylsulfonyl group or an alkylphosphonyl group having 1 to 22 carbon atoms, or an arylsulfonyl group or an arylphosphonyl group having from 6 to 24 carbon atoms.

17. An electrophotographic liquid developer as in claim 16, wherein A represents an alkylene group havign from 1 to 10 carbon atoms.

18. An electrophotographic liquid developer as in claim 17, wherein X represents a titanium atom, a cobalt atom, a zirconium atom or nickel atom.

19. An electrophotographic liquid developer as in claim 1, wherein the electric charge adjustor is used in an amount of from 0.01 g to 100 g per liter of carrier liquid.

* * * * *